US009298127B2

(12) United States Patent
Sakagawa et al.

(10) Patent No.: US 9,298,127 B2
(45) Date of Patent: Mar. 29, 2016

(54) DEVELOPING DEVICE AND IMAGE FORMING APPARATUS INCLUDING SAME

(71) Applicants: Yoshio Sakagawa, Hyogo (JP); Shin Murayama, Hyogo (JP); Yasuhide Matsuno, Osaka (JP)

(72) Inventors: Yoshio Sakagawa, Hyogo (JP); Shin Murayama, Hyogo (JP); Yasuhide Matsuno, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/456,032

(22) Filed: Aug. 11, 2014

(65) Prior Publication Data

US 2015/0055987 A1 Feb. 26, 2015

(30) Foreign Application Priority Data

Aug. 21, 2013 (JP) ..... 2013/171388

(51) Int. Cl.
*G03G 15/08* (2006.01)
*G03G 15/095* (2006.01)

(52) U.S. Cl.
CPC ..... *G03G 15/081* (2013.01); *G03G 15/0812* (2013.01); *G03G 15/0844* (2013.01)

(58) Field of Classification Search
CPC ..... G03G 15/081; G03G 15/0844
See application file for complete search history.

(56) References Cited

U.S. PATENT DOCUMENTS 5,036,364 A * 7/1991 Murasawa ..... 399/236
7,567,764 B2 * 7/2009 Yamanaka et al. ..... 399/53
7,702,266 B2 * 4/2010 Kazaki et al. ..... 399/279
8,355,657 B2 * 1/2013 Kadota et al. ..... 399/266
2008/0131174 A1 6/2008 Inoue et al.
2008/0175626 A1 7/2008 Murayama et al.
2008/0240783 A1 * 10/2008 Foster et al. ..... 399/167
2010/0028057 A1 2/2010 Yamada et al.
2012/0045254 A1 2/2012 Inoue et al.
2013/0236217 A1 9/2013 Nagatomo et al.

FOREIGN PATENT DOCUMENTS

JP 2001356589 A * 12/2001
JP 2004-264553 9/2004
JP 2007-328088 12/2007

* cited by examiner

*Primary Examiner* — Clayton E LaBalle
*Assistant Examiner* — Leon W Rhodes, Jr.
(74) *Attorney, Agent, or Firm* — Oblon, McClelland, Maier & Neustadt, L.L.P.

(57) ABSTRACT

A developing device includes a developer bearer and a regulation member. The developer bearer bears developer on a surface thereof. The developer bearer is rotatable forward and in reverse. The regulation member is disposed in contact or non-contact with the surface of the developer bearer to regulate amount of the developer on the developer bearer. In a non-development period, when the developer bearer rotates in a direction of reverse rotation opposite to a direction of forward rotation in which the developer bearer rotates in a development period, the developer bearer stops a series of rotating operations after the developer bearer rotates in the direction of forward rotation as a last rotating operation. A total rotation amount of forward rotation is set to be greater than a total rotation amount of reverse rotation in the series of rotating operations.

13 Claims, 8 Drawing Sheets

DEVELOPING DEVICE AND IMAGE FORMING APPARATUS INCLUDING SAME

CROSS-REFERENCE TO RELATED APPLICATIONS

This patent application is based on and claims priority pursuant to 35 U.S.C. §119(a) to Japanese Patent Application No. 2013-171388, filed on Aug. 21, 2013, in the Japan Patent Office, the entire disclosure of which is hereby incorporated by reference herein.

BACKGROUND

1. Technical Field

Embodiments of the present disclosure relate to a developing device in which a developer bearer is rotatable in forward and reverse directions and an image forming apparatus including the developing device.

2. Description of the Related Art

In an electrophotographic image forming apparatus, a surface of a photoconductor as a latent image bearer is uniformly charged by a charging device, an exposing device exposes the charging surface of the photoconductor based on an original image so as to form a latent image, and a developing device causes toner as developer to adhere to the latent image so as to form a toner image. The developing device includes a developing roller which serves as a developer bearer, a regulation member that is disposed in a non-contact state while contacting a surface of the developing roller or forming a minute gap therebetween, and the like. The developer borne on the developing roller is regulated in a uniform thickness by the regulation member, is transported to a position opposing the photoconductor, and is supplied onto the photoconductor. Then, the toner image formed on the photoconductor is transferred to a recording medium such as paper by a transfer device, and is output while being fixed to the recording medium by a fixing device. Further, a small amount of toner which remains on the photoconductor after the toner image is transferred is removed by a cleaner.

As the cleaner that removes a residual toner on the photoconductor, a method is widely adopted which uses a cleaning member having a shape of blade and scrapes off the residual toner by the cleaning member. However, in this method, a cleaning failure may be caused by a foreign material such as a paper powder stuck between the cleaning member and the photoconductor. In order to prevent this cleaning failure, a method is known which rotates a photoconductor in a direction opposite to a rotation direction in an image forming operation and removes a foreign material stuck between a cleaning member and the photoconductor.

SUMMARY

In at least one embodiment of this disclosure, there is an improved developing device including a developer bearer and a regulation member. The developer bearer bears developer on a surface thereof. The developer bearer is rotatable forward and in reverse. The regulation member is disposed in contact or non-contact with the surface of the developer bearer to regulate amount of the developer on the developer bearer. In a non-development period, when the developer bearer rotates in a direction of reverse rotation opposite to a direction of forward rotation in which the developer bearer rotates in a development period, the developer bearer stops a series of rotating operations after the developer bearer rotates in the direction of forward rotation as a last rotating operation. A total rotation amount of forward rotation is set to be greater than a total rotation amount of reverse rotation in the series of rotating operations.

In at least one embodiment of this disclosure, there is an improved image forming apparatus including the above-described developing device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
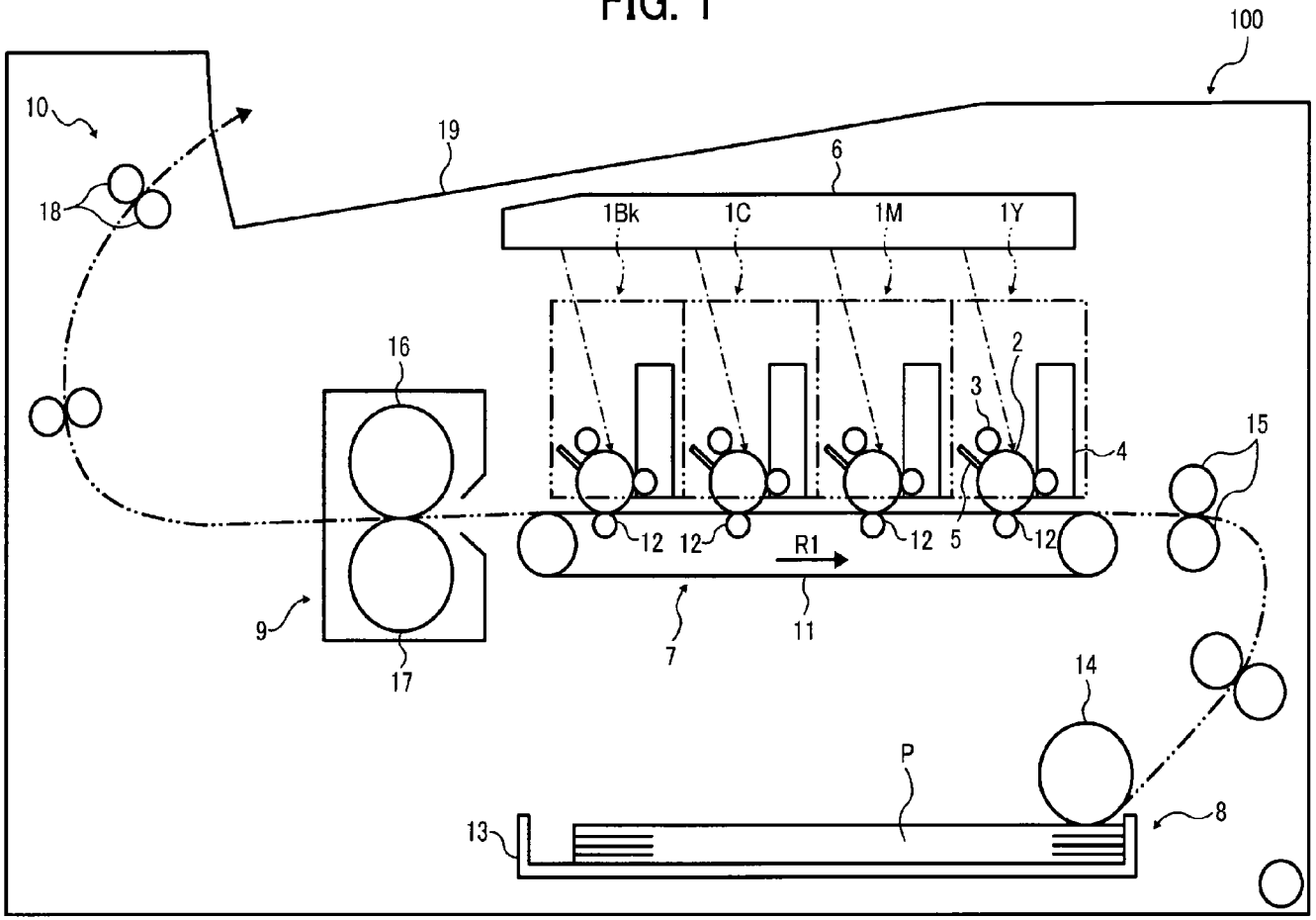
FIG. 1 a schematic view of a configuration of an image forming apparatus according to an embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

Hereinafter, embodiments of the disclosure will be described with reference to the accompanying drawings. Furthermore, in the drawings, constituents such as members or components having the same function or shape are denoted by the same reference numeral which may be determined, and are described once. Then, the repetitive description thereof will not be presented.

FIG. 1 is a schematic view of a configuration of an image forming apparatus according to an embodiment of the disclosure. First, the entire configuration and the operation of the image forming apparatus will be described with reference to FIG. 1.

The image forming apparatus illustrated in FIG. 1 includes four process units 1Y, 1M, 1C, and 1Bk as imaging units which form images of different colors of yellow (Y), magenta (M), cyan (C), and black (Bk) corresponding to color separation components of a color image. The process units 1Y, 1M, 1C, and 1Bk are detachably attached to an apparatus body 100, and have the same configuration except that developers of different colors are stored therein.

Specifically, each of the process units 1Y, 1M, 1C, and 1Bk includes a photoconductor 2 which serves as an image bearer having an image on the surface thereof, a charging roller 3 which serves as a charger charging the surface of the photoconductor 2, a developing device 4 which serves as a developing unit making a latent image on the photoconductor 2 visible, and a cleaning blade 5 which serves as a cleaning member contacting the surface of the photoconductor 2 to clean the surface. Furthermore, in FIG. 1, the reference numerals are given to only the photoconductor 2, the charging roller 3, the developing device 4, and the cleaning blade 5 included in the process unit 1Y for a yellow image, and the reference numerals for the other process units 1M, 1C, and 1Bk are omitted.

Further, the image forming apparatus includes an exposing device 6 which exposes the surfaces of the photoconductors 2, a transfer device 7 which transfers an image to a sheet as a recording medium, a sheet feeding device 8 which feeds a sheet, a fixing device 9 which fixes an image transferred to a sheet, and a sheet discharging device 10 which discharges a sheet to the outside of the apparatus.

The exposing device 6 includes a light source, a polygon mirror, a f-θ lens, a reflection mirror, and the like, and irradiates a laser beam to the surfaces of the photoconductors 2 based on an image data.

The transfer device 7 includes an endless transfer conveyance belt 11 which is stretched over a plurality of rollers and four transfer rollers 12 which are disposed to oppose the photoconductors 2. Each transfer roller 12 contacts the photoconductor 2 with the transfer conveyance belt 11 interposed therebetween. Accordingly, the transfer conveyance belt 11 and each photoconductor 2 contact each other, so that a transfer nip is formed in each contact portion. Further, each transfer roller 12 is connected to a power supply, and is applied with a predetermined DC voltage (DC) and/or an AC voltage (AC).

The sheet feeding device 8 includes a sheet feed tray 13 which accommodates a sheet P or a sheet feed roller 14 which feeds the sheet P accommodated in the sheet feed tray 13. Further, a pair of registration rollers 15 which serves as timing rollers is provided at the downstream side in the sheet conveyance direction with respect to the sheet feed roller 14 to convey the sheet to the transfer conveyance belt 11 by measuring a conveying timing. Furthermore, examples of the sheet P include thick paper, a postcard, an envelope, plain paper, thin paper, coated paper (coated paper or art paper), and tracing paper. Further, an overhead projector (OHP) sheet or an OHP film may be used as a recording medium other than the sheet.

The fixing device 9 includes a fixing roller 16 as a fixing member and a pressure roller 17 as a pressure member. The fixing roller 16 is heated by a heat source such as a heater. The pressure roller 17 is pressed against the fixing roller 16 to contact the fixing roller 16, so that a fixing nip is formed at the contact portion.

The sheet discharging device 10 includes a pair of discharge rollers 18. The sheet which is discharged to the outside of the apparatus by the discharge rollers 18 is stacked on a discharge tray 19 in which the top surface of the apparatus body 100 is recessed.

Subsequently, an imaging operation of the image forming apparatus according to this embodiment will be described with reference to FIG. 1. When the imaging operation is started, the photoconductors 2 of the process units 1Y, 1M, 1C, and 1Bk are rotationally driven in the clockwise direction of FIG. 1, and the surfaces of the photoconductors 2 are uniformly charged by the charging rollers 3. Based on image information supplied from a reading device or a computer, an electric latent image is formed on the charging surfaces of the photoconductors 2 by the exposure from the exposing device 6. At this time, the image information used for the exposure of the photoconductors 2 is monochromatic image information which is obtained by separating a desired full-color image into the color information of yellow, cyan, magenta and black. Then, when toner is supplied from the developing devices 4 to the electric latent images formed on the photoconductors 2. the electric latent images are developed (visualized) as toner images.

Further, when an imaging operation is started, the sheet feed roller 14 starts to be rotationally driven, and hence the sheet P is delivered from the sheet feed tray 13. The transportation of the delivered sheet P is temporarily stopped by a registration roller 15. Subsequently, the registration roller 15 starts to be rotationally driven at a predetermined timing so as to convey the sheet P to the transfer conveyance belt 11.

Then, the sheet P which is borne on the transfer conveyance belt 11 is conveyed when the transfer conveyance belt 11 rotates in a direction indicated by arrow R1 in FIG. 1. At this time, the toner images formed on the photoconductors 2 are transferred at a transfer nip where the photoconductors 2 oppose the transfer rollers 12 so that the toner images are superimposed one on another on the sheet P conveyed along the transfer conveyance belt 11.

Specifically, when a transfer voltage having polarity opposite to the toner charging polarity is applied to the transfer rollers 12, a transfer electric field is formed at the transfer nips, and the toner images on the photoconductors 2 are transferred onto the sheet P by the electrostatic force of the transfer electric field.

Subsequently, the sheet P is conveyed to the fixing device 9, and is heated and pressurized while passing through a fixing nip between the fixing roller 16 and the pressure roller 17, so that the toner image on the sheet P is fixed. Then, the sheet P is discharged to the outside of the apparatus by the discharge rollers 18 to be stocked on the discharge tray 19.

The description above corresponds to the image forming operation when a full-color image is formed on the sheet. However, a monochromatic image may be formed by using any one of four process units 1Y, 1M, 1C, and 1Bk or an image of two colors or three colors may be formed by using two or three process units.

Figure 2:
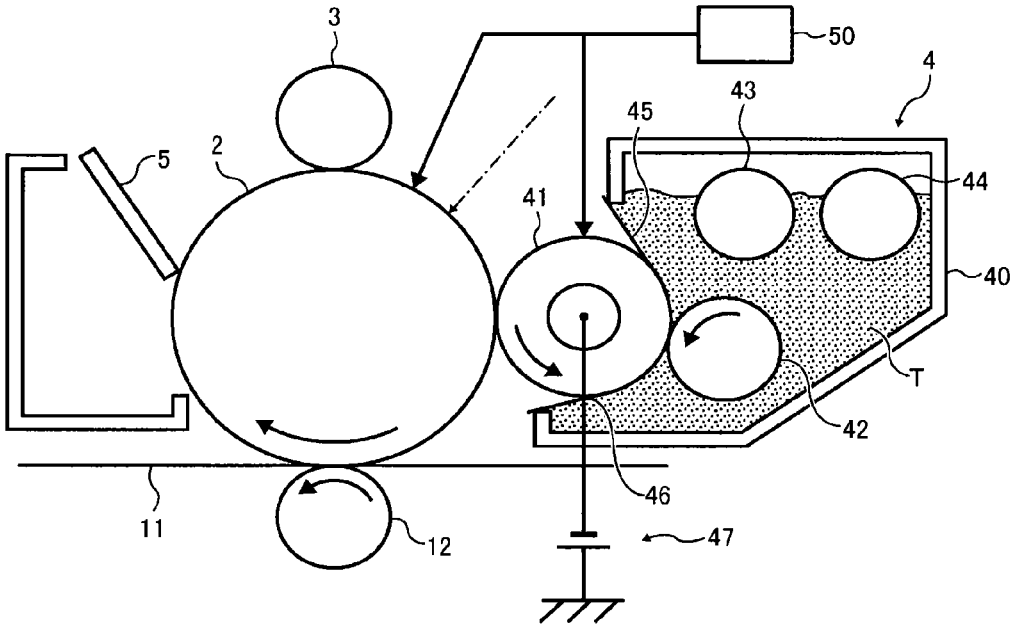
FIG. 2 is a schematic view of a configuration of a process unit according to an embodiment of the present disclosure.

FIG. 2 is a schematic view of a configuration of the process unit. Hereinafter, a configuration of the developing device included in the process unit will be described with reference to FIG. 2.

As illustrated in FIG. 2, the developing device 4 includes a development container 40 which stores toner T, a developing roller 41 which serves as a developer bearer bearing toner on the surface thereof, a supply roller 42 which serves as a developer supply member supplying toner to the surface of the developing roller 41, two transport screws 43 and 44 which serves as a transport member transporting toner to the supply roller 42, a regulating blade 45 which serves as a regulation member regulating the amount of the toner supplied to the developing roller 41, and an inlet seal 46 which prevents toner from leaking from the development container 40.

As developer used to form an electrophotographic image, one-component developer including only toner and two-component developer including toner and magnetic carrier are generally used. In this embodiment, one-component developer is used in the developing device.

The developing roller 41 has a structure in which a conductive rubber layer is formed on an outer circumference of a metal shaft. As the conductive rubber layer, for example, urethane rubber may be used, but epichlorohydrin rubber, silicone rubber, ethylene propylene diene monomer (EPDM), and the like may be used. A development-bias power source 47 is connected to the developing roller 41, and a predetermined development bias is applied thereto. Further, the developing roller 41 is rotationally driven by a driving force generated from a motor 50 as a driving source, but the motor 50 also serves as a driving source that rotationally drives the photoconductor 2. That is, in this embodiment, the developing roller 41 and the photoconductor 2 may be driven by the common motor 50. The developing roller 41 contacts the photoconductor 2 at a predetermined pressure, and a development nip is formed at the contact portion therebetween.

The supply roller 42 has, for example, a structure in which a foamed rubber layer is coated on an outer circumference of a metal shaft. As the foamed rubber layer, polyurethane, epichlorohydrin rubber, silicone rubber, EPDM, and the like may be used. The supply roller 42 contacts the developing roller 41 in a pressed state, so that a supply nip is formed at the contact portion therebetween.

The regulating blade 45 is formed of, for example, a metal leaf spring material such as SUS. Furthermore, a blade which is formed by processing a resin or rubber material in a shape of blade or a shape of film may be used other than the metal leaf spring material. The free end side (the leading side) of the regulating blade 45 contacts the surface of the developing roller 41 by a predetermined pressing force, and a regulating nip is formed at the contact portion.

When there is an instruction of starting the imaging operation, the toner inside the development container 40 is carried to the supply nip by the rotating supply roller 42 so that the toner is supplied to the surface of the developing roller 41. The toner borne on the developing roller 41 passes through the regulating nip of the regulating blade 45 with the rotation of the developing roller 41. Accordingly, the thickness of the toner layer is regulated and the friction charge occurs. Then, when the toner on the developing roller 41 is transported to the development nip, the toner image is formed in a manner such that the toner is transferred from the developing roller 41 to the electric latent image of the photoconductor 2 due to the force of the electric field generated between the photoconductor 2 and the developing roller 41 applied with a development bias.

Further, the toner which is not transferred onto the photoconductor 2 and remains on the developing roller 41 is returned into the development container 40 again. The inlet seal 46 is provided at the inlet portion of the development container 40 to which the toner is returned, and hence the toner is sealed by the inlet seal 46 so that the toner does not leak from the development container 40.

Figure 3A:
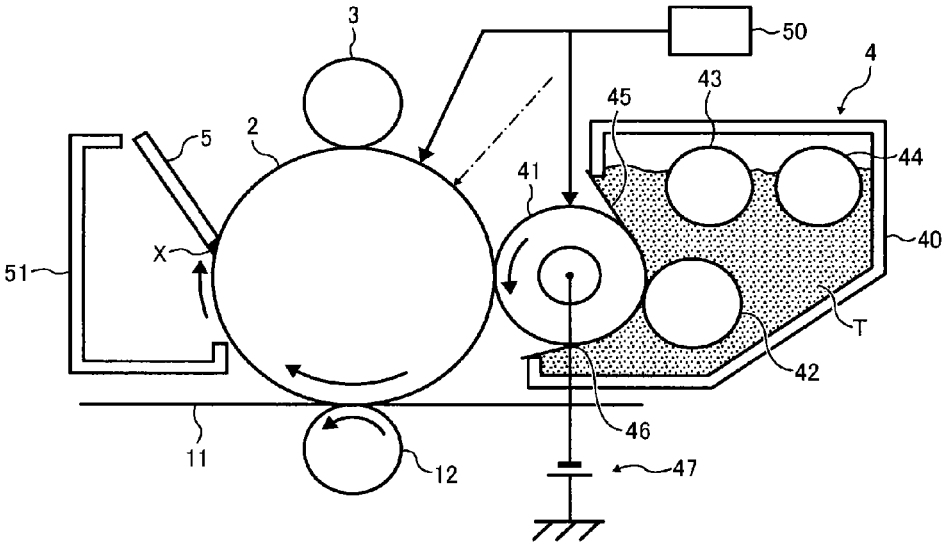
FIGS. 3A, 3B, and 3C are explanatory views illustrating an operation of a developing device according to an embodiment of the present disclosure.

Here, as described above, in the configuration in which the cleaning member having a shape of blade is used as the cleaner cleaning the surface of the photoconductor, a problem arises in that a cleaning failure is caused by a foreign material such as a power powder stuck between the cleaning member and the photoconductor. There is a possibility that the same problem may arise even in this embodiment. Then, as illustrated in FIG. 3A, there is a concern that a cleaning failure may occur due to a foreign material X stuck between the cleaning blade 5 and the photoconductor 2. Particularly, in the direct transfer system in which the image on the photoconductor 2 is directly transferred onto the sheet as in this embodiment, there is a tendency that a foreign material such as a paper powder adhering to the surface of the photoconductor 2 is stuck between the cleaning blade 5 and the photoconductor 2.

Figure 3B:
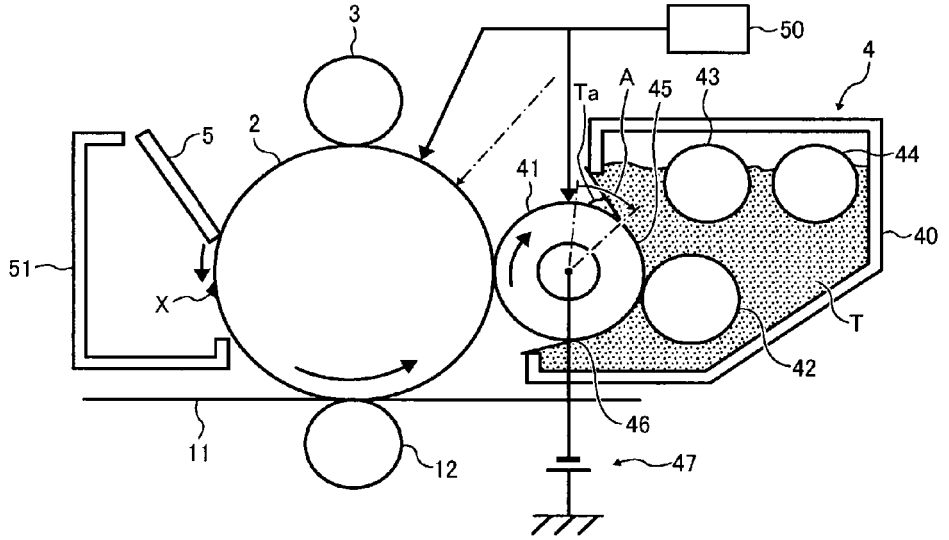

Therefore, in this embodiment, as illustrated in FIG. 3B, the photoconductor 2 which does not perform the image forming operation (in a non-development state) is rotated in a direction opposite to the rotation direction (the forward direction) during the image forming operation as in the related art so that the foreign material X is discharged from a gap between the cleaning blade 5 and the photoconductor 2.

In this way, in this embodiment, the foreign material X stuck between the photoconductor 2 and the cleaning blade 5 may be removed by the reverse rotation of the photoconductor 2. Meanwhile, a problem arises in that toner is accumulated on the leading end of the regulating blade 45. In this embodiment, since the developing roller 41 is rotated by the common motor 50 along with the photoconductor 2, the developing roller 41 also rotates (reversely rotates) in a direction opposite to the rotation direction (the forward rotation) in the development operation with the reverse rotation of the photoconductor 2. As a result, as illustrated in FIG. 3B, the toner layer borne on the developing roller 41 may be blocked at the leading end position of the regulating blade 45, and hence toner Ta is accumulated between the regulating blade 45 and the developing roller 41. Then, when this state is left in such a state for a long period of time, the accumulated toner Ta adheres onto the developing roller 41. Due to this reason, there is a concern that an image failure such as an uneven image density or a lateral black streak image may occur.

Figure 3C:
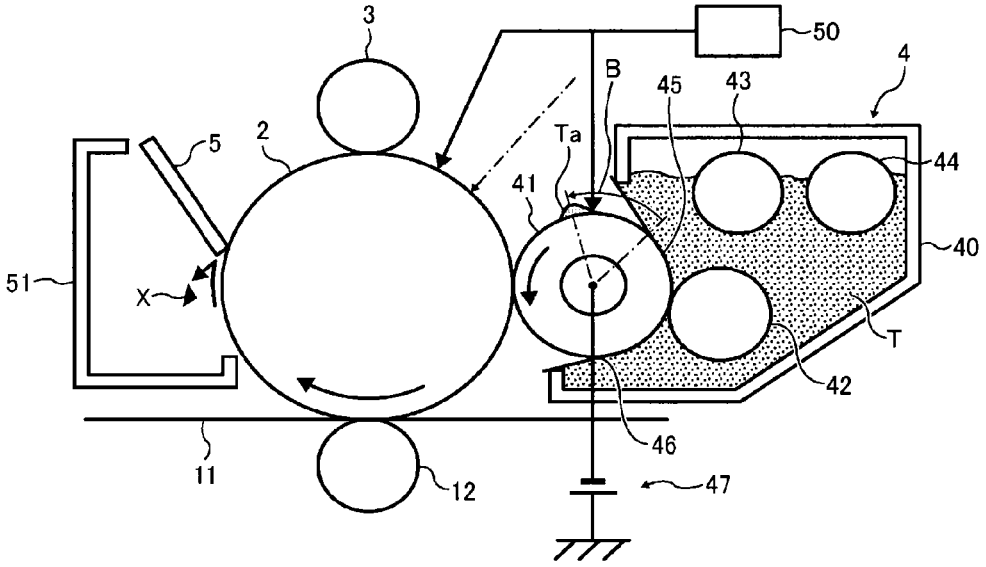

In order to prevent this problem, in this embodiment, as illustrated in FIG. 3C, the developing roller 41 (and the photoconductor 2) is rotated forward after the reverse rotation. Furthermore, a rotation amount B (see FIG. 3C) of the forward rotation is set to be larger than a rotation amount A (see FIG. 3B) of the reverse rotation. The "rotation amount" mentioned herein indicates a distance at which the surface of the developing roller rotates, but the rotation amount may be set based on the rotation angle or the rotation time other than the rotation distance.

The reverse rotation of the developing roller may be performed in order to remove a foreign material such as an aggregation toner or dust stuck between the developing roller and the regulation member. However, even in this case, when the developing roller is stopped in a reverse rotation state and is left in such a state for a long period of time as described above, a problem arises in that the toner accumulated on the leading end of the regulation member adheres to the developing roller.

Hence, as described above, since the developing roller 41 is rotated forward so that the rotation amount is larger than the reverse rotation amount, the accumulated toner Ta may be discharged from the gap between the regulating blade 45 and the developing roller 41. Further, the foreign materials X on the photoconductors 2 are removed from the photoconductors 2 by the cleaning blades 5 by the simultaneous forward rotation of the photoconductors 2 to be collected into a cleaning container 51. Then, since the rotation of the developing roller 41 ends after the forward rotation thereof without the reverse rotation thereof, it is possible to maintain a state where the accumulated toner Ta does not exist on the leading end of the regulating blade 45. Thus, since the accumulated toner Ta does not adhere to the surface of the developing roller 41 even when this state is left for a long period of time. the image failure may be prevented.

Figure 4:
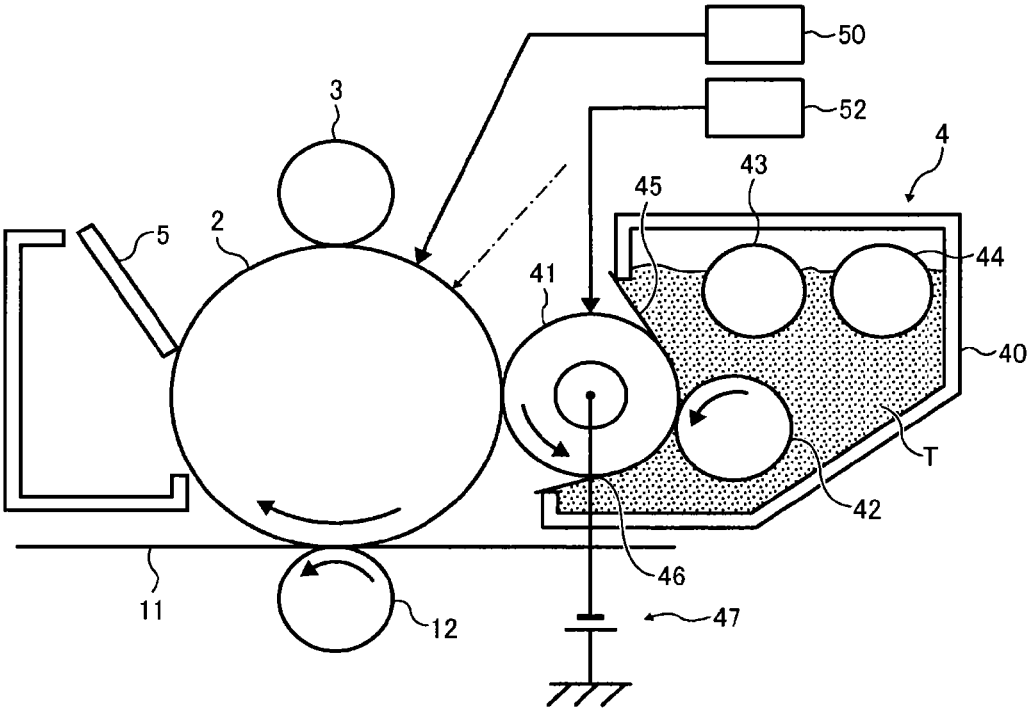
FIG. 4 is a view illustrating a configuration of a developing device according to another embodiment of the disclosure.

FIG. 4 is a view illustrating a configuration of a developing device according to another embodiment of the disclosure. In the configuration illustrated in FIG. 4, the developing roller 41 and the photoconductor 2 are driven by separate motors 50 and 52 differently from the above-described embodiment. The other configurations are the same as those of the above-described embodiment.

Figure 5A:
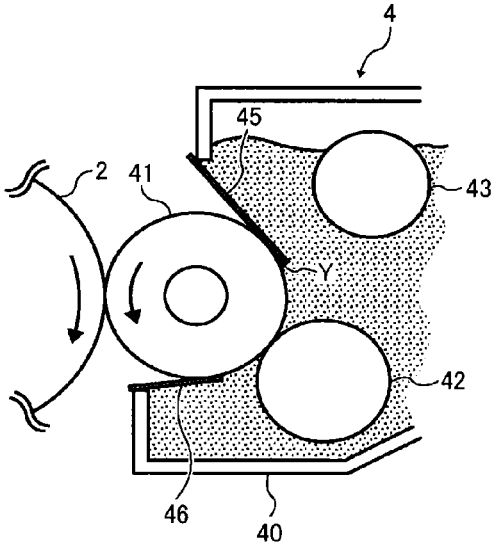
FIGS. 5A, 5B, and 5C are explanatory views illustrating an operation of a developing device according to an embodiment of the present disclosure.

In this case, the developing roller 41 does not rotate reversely along with the reverse rotation of the photoconductor 2 as in the above-described embodiment. However, as illustrated in FIG. 5A, a foreign material Y such as an aggregation toner or dust is stuck between the regulating blade 45 and the developing roller 41. Since there is a concern that an abnormal image such a lateral white streak occurs due to this reason, the developing roller 41 may be rotated reversely in order to remove the foreign material Y. However, when the developing roller 41 is rotated reversely, a problem arises in that the accumulated toner Ta is formed between the regulating blade 45 and the developing roller 41 due to the reverse rotation of the developing roller 41 as illustrated in FIG. 5B as in the above-described embodiment.

Figure 5B:
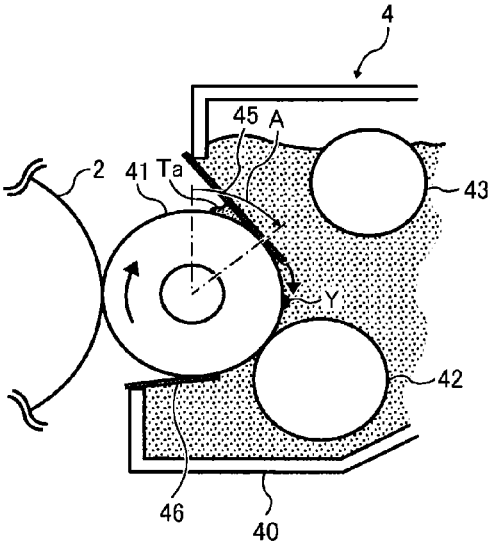
Figure 5C:
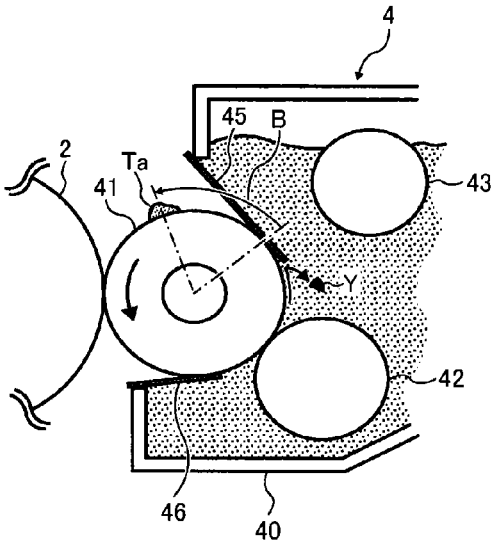

For that reason, even in this case, the rotation of the developing roller 41 ends after the developing roller 41 rotates forward after the reverse rotation thereof as illustrated in FIG. 5C. Furthermore, the forward rotation amount B (see FIG. 5C) is set to be larger than the reverse rotation amount A (see FIG. 5B). Accordingly, the accumulated toner Ta is discharged from the gap between the regulating blade 45 and the developing roller 41. and hence the image failure caused by the adherence of the accumulated toner Ta may be prevented. Further, the foreign material Y on the developing roller 41 is removed from the developing roller 41 by the regulating blade 45 in accordance with the forward rotation of the developing roller, and is collected into the development container 40.

In FIGS. 5A to 5C, a case has been exemplified in which the driving sources of the developing roller 41 and the photoconductor 2 are separated from each other in the reverse rotation and the forward rotation of the developing roller 41 when the foreign material Y is stuck between the regulating blade 45 and the developing roller 41. However, even in the configuration in which both driving sources are common, the developing roller 41 may be rotated reversely and forward for the same reason.

In the above-described embodiments, each of the reverse rotation and the forward rotation of the developing roller 41 is performed once in a series of rotating operations of the developing roller 41 in a non-development state, but may performed plural times. When the reverse rotation and the forward rotation are performed plural times, it is possible to more reliably remove the foreign material stuck to the leading end of the cleaning blade 5 or the regulating blade 45.

Further, the number of times of the reverse rotation and the forward rotation of the developing roller 41 may be changed. For example, in the initial stage in which the number of printed sheets in total is small, the amount of the foreign material accumulated on the leading end of the cleaning blade 5 or the regulating blade 45 is small. For this reason, when a control is performed so that the number of times of the reverse rotation and the forward rotation decreases and increases as the number of printed sheets in total increases, the foreign material may be effectively and efficiently removed.

However, when the reverse rotation and the forward rotation of the developing roller 41 are repeated plural times, the total forward rotation amount is set to be larger than the total reverse rotation amount in the series of rotating operations. For example, when the reverse rotation and the forward rotation are alternately repeated three times, an equation of $A1+A2+A3<B1+B2+B3$ is satisfied on the assumption that the rotation amounts during the reverse rotation are respectively denoted by A1, A2, and A3 and the rotation amounts during the forward rotation are respectively denoted by B1, B2, and B3. In this way, when the total forward rotation amount is set to be larger than the total reverse rotation amount, the toner accumulated on the leading end of the regulating blade 45 may be discharged from the gap between the regulating blade 45 and the developing roller 41 by the reverse rotation of the developing roller.

Further, when the reverse rotation and the forward rotation are performed plural times, there is a need to pay attention that the foreign material is not bitten between the cleaning blade 5 and the photoconductor 2 or between the regulating blade 45 and the developing roller 41. In order to prevent the biting of the foreign material, it is desirable that the last forward rotation amount be set to be smaller than the precedent reverse rotation amount. However, since the last forward rotation amount is set to be larger than the precedent reverse rotation amount, the total forward rotation amount is adjusted so as to be larger than the total reverse rotation amount. For example, when each of the reverse rotation and the forward rotation is performed three times, the first forward rotation amount B1 is set to be smaller than the (first) precedent reverse rotation amount A1 ($B1<A1$), and the second forward rotation amount B2 is set to be smaller than the (second) precedent reverse rotation amount A2 ($B2<A2$). However, the third forward rotation amount B3 is set to be larger than the (third) precedent reverse rotation amount A3 ($B3>A3$). Furthermore, the total amount of the forward rotation performed three times is set to be larger than the total amount of the reverse rotation performed three times ($A1+A2+A3<B1+B2+B3$).

Likewise, in this embodiment, in the case where the developing roller 41 is rotated reversely in a non-development state, a series of rotating operations ends after the developing roller 41 is rotated forward after the reverse rotation of the developing roller 41 and the total forward rotation amount is set to be larger than the total reverse rotation amount in the series of rotating operations. Thus, it is possible to discharge the toner accumulated on the leading end of the regulating blade 45 by the reverse rotation. Accordingly, it is possible to prevent the toner from adhering to the developing roller 41 when the toner is stuck between the developing roller and the regulating blade for a long period of time and hence to prevent the image failure.

Further, a configuration may be employed in which the remaining time for which the developing device stops is managed and the rotation of the developing roller 41 is controlled based on the remaining time. Specifically, a configuration is employed in which a time in which the driving of the developing device stops is counted by a time counter such as a timer, the developing roller 41 is automatically and rotationally driven at the time point exceeding a predetermined time (for example, three days), and the developing roller 41 is stopped in a forward rotation state at last. Accordingly, it is possible to discharge the accumulated toner from the gap between the regulating blade 45 and the developing roller 41 before the adherence of the accumulated toner, and hence to prevent the toner from adhering to the developing roller 41.

Further, the adherence of the toner to the developing roller 41 may easily occur particularly when the following toner is used. The first case is that toner having a small particle diameter and a low softening point is used. Such toner easily enters between the regulating blade 45 and the developing roller 41 and adheres thereto in a fused state. Specifically, toner is used of which the particle diameter is 8 μm or less and the softening point is 130° C. or less.

Further, the adherence of the toner easily occurs even in the case where toner having an external additive of 3 parts by weight or less with respect to the toner mother particle of 100 parts by weight is used. When the amount of the external additive is small, it is difficult to obtain a spacer effect due to the external additive intervened between the mother particle and the surface of the developing roller. That is, since the mother particle easily contacts the surface of the developing roller, the adherence of the toner easily occurs.

Further, even when a polymerized toner is used, the adherence of the toner easily occurs. Since the polymerized toner has a spherical shape, the toner easily enters between the regulating blade 45 and the developing roller 41 and easily adheres therebetween.

Thus, when the toner that easily causes the above-described adherence is used, a particularly noticeable toner adherence preventing effect may be expected by employing the configuration of this embodiment.

Further, an embodiment of this disclosure is not limited to the above-described configuration and may be, of course, modified into various forms in the scope without departing from the spirit of the invention.

In the above-described embodiment, a configuration using a one-component developer is described, but a developing device according to an embodiment of this disclosure may have a configuration using a two-component developer.

Figure 6:
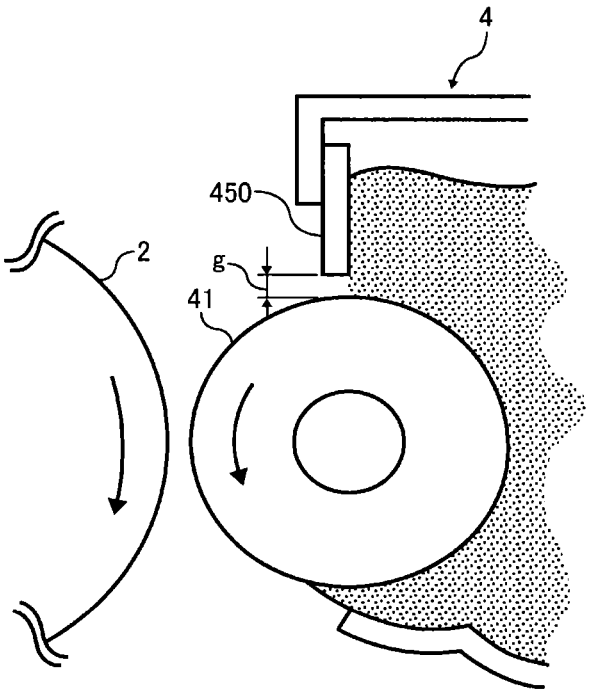
FIG. 6 is a schematic view of a configuration of a developing device using a two-component developer according to an embodiment of the present disclosure.

As illustrated in FIG. 6, in a developing device using a two-component developer, a regulation member 450 which regulates the amount of the toner on the developing roller 41 is disposed in a non-contact state with a minute gap g between the regulation member and the surface of the developing roller 41. There is a case in which a foreign material such as an aggregation toner is stuck even in the minute gap g between the regulation member 450 and the developing roller 41. In order to prevent this problem, there is a need to rotate the developing roller 41 reversely. However, when the developing roller 41 is rotated reversely, a problem arises in that the toner borne on the developing roller 41 is accumulated between the regulation member 450 and the developing roller 41 due to the reverse rotation of the developing roller 41 as in the case of the one-component developer. Thus, even in the developing device using the two-component developer, when the developing roller 41 is rotated reversely and the forward rotation amount is set to be larger than the reverse rotation amount, the accumulated toner is discharged from the leading end of the regulation member 450. Accordingly, the adherence of the toner may be prevented.

Figure 7:
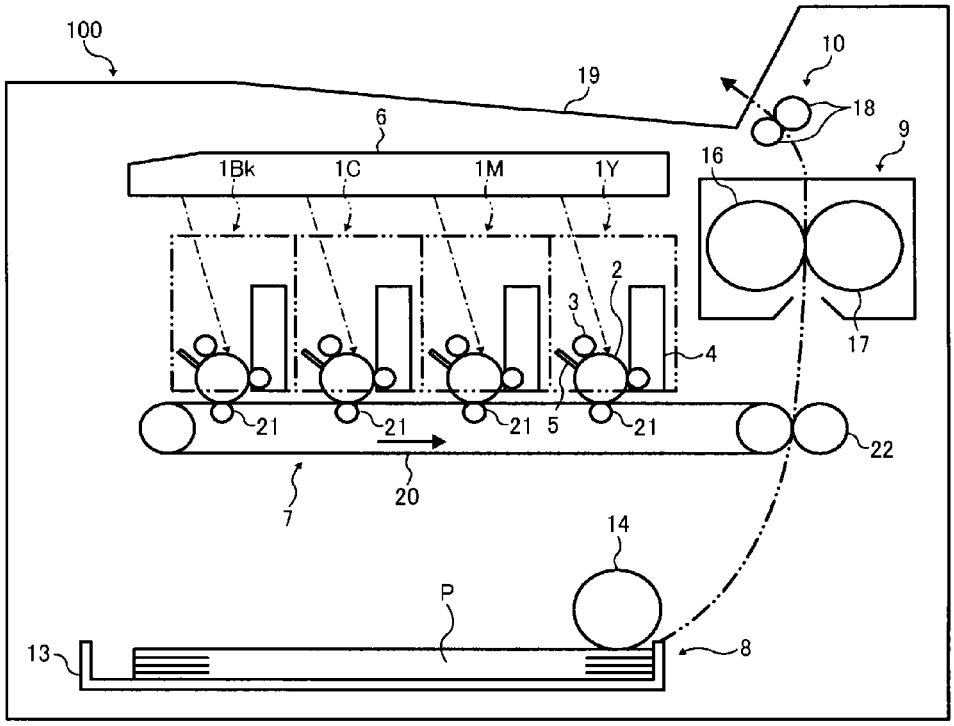
FIG. 7 is a schematic view of a configuration of an image forming apparatus of an indirect transfer system according to an embodiment of the present disclosure.

FIG. 7 is a schematic view of a configuration of an image forming apparatus of an indirect transfer system. Similarly to the direct transfer system, the image forming apparatus of the indirect transfer system generally includes process units 1Y, 1M, 1C, and 1Bk as the imaging units, an exposing device 6, a transfer device 7, a sheet feeding device 8, a fixing device 9, and a sheet discharging device 10. However, as not in the case of the direct transfer system, the transfer device 7 includes an endless intermediate transfer belt 20 as an intermediate transfer body, a plurality of primary transfer rollers 21 as primary transfer units, and a secondary transfer roller 22 as a secondary transfer unit. As the indirect transfer system, the toner images on the photoconductors 2 are transferred to the intermediate transfer belt 20 so that the toner images are sequentially superimposed on one another at the positions of the primary transfer rollers 21. Subsequently, the toner image on the intermediate transfer belt 20 is transferred onto a sheet P sent from the sheet feeding device 8 at the position of the secondary transfer roller 22. The configuration of the image forming apparatus is not limited to the direct transfer system illustrated in FIG. 1, and may be such an indirect transfer system. Further, the image forming apparatus may be a printer, a copier, a facsimile, or a multi-functional device thereof.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A developing device, comprising:

a developer bearer to bear developer on a surface thereof, the developer bearer being rotatable forward and in reverse; and a regulation member disposed in contact or non-contact with the surface of the developer bearer to regulate amount of the developer on the developer bearer, wherein, in a non-development period, when the developer bearer rotates in a direction of reverse rotation opposite to a direction of forward rotation in which the developer bearer rotates in a development period, the developer bearer stops a series of rotating operations after the developer bearer rotates in the direction of forward rotation as a last rotating operation, and a total rotation amount of forward rotation is set to be greater than a total rotation amount of reverse rotation in the series of rotating operations, and wherein in the non-development period, the reverse rotation and the forward rotation of the developer bearer are alternately performed plural times, the rotation amount of forward rotation in the last rotating operation is set to be greater than the rotation amount of reverse rotation precedent to the forward rotation in the last rotating operation, and a rotation amount of forward rotation in a rotating operation other than the last rotating operation is set to be smaller than the rotation amount of the reverse rotation precedent to the forward rotation in the last rotating operation.

2. The developing device according to claim 1, wherein number of times of the forward rotation and the reverse rotation of the developer bearer in the non-development period is adjustable.

3. The developing device according to claim 1, wherein when a predetermined time elapses from a stop of driving of the developer bearer, the developer bearer automatically starts rotation and stops the rotation after the developer bearer rotates in the direction of forward rotation as the last rotating operation.

4. The developing device according to claim 1, wherein the developer includes a toner having a particle diameter of 8 μm or less and a softening point of 130° C. or less.

5. The developing device according to claim 1, wherein the developer includes a toner having an external additive of 3 parts by weight or less with respect to a toner mother particle of 100 parts by weight.

6. The developing device according to claim 1, wherein the developer includes a polymerized toner.

7. An image forming apparatus comprising the developing device according to claim 1.

8. The image forming apparatus according to claim 7, further comprising:

an image bearer to bear an image on a surface thereof;

a cleaning member to contact the surface of the image bearer to clean the surface of the image bearer; and a transfer device to directly transfer the image from the image bearer to a recording medium.

9. The image forming apparatus according to claim 7, further comprising plural driving sources to separately drive the image bearer and the developer bearer.

10. The developing device according to claim 1, further comprising a development container that contains the developer and that partially surrounds the developer bearer, wherein the regulation member extends from one end of the development container and an inlet seal extends from another end of the development container so that the developer does not leak from the development container.

11. A developing device, comprising:

a developer bearer to bear developer on a surface thereof, the developer bearer being rotatable forward and in reverse; and a regulation member including a first end in contact or non-contact with the surface of the developer bearer to regulate amount of the developer on the developer bearer, wherein, in a non-development period, when the developer bearer rotates in a direction of reverse rotation opposite to a direction of forward rotation in which the developer bearer rotates in a development period, the developer bearer stops a series of rotating operations after the developer bearer rotates in the direction of forward rotation as a last rotating operation, and a total rotation amount of forward rotation is set to be greater than a total rotation amount of reverse rotation in the series of rotating operations, and wherein the regulation member includes a second end opposite to the first end and the second end is downstream of the first end in the direction of forward rotation.

12. The developing device according to claim 11, wherein the non-development period, the reverse rotation and the forward rotation of the developer bearer are alternately performed plural times, the rotation amount of forward rotation in the last rotating operation is set to be greater than the rotation amount of reverse rotation precedent to the forward rotation in the last rotating operation, and a rotation amount of forward rotation in a rotating operation other than the last rotating operation is set to be smaller than the rotation amount of the reverse rotation precedent to the forward rotation in the last rotating operation.

13. An image forming apparatus comprising the developing device according to claim 11.

* * * * *